United States Patent [19]

Anderson

[11] Patent Number: 4,545,671

[45] Date of Patent: Oct. 8, 1985

[54] APPARATUS FOR GUIDING AND COOLING A HEATED IMAGE-CARRYING SUPPORT

[75] Inventor: Clifford L. Anderson, Rochester, N.Y.

[73] Assignee: Eastman Kodak Company, Rochester, N.Y.

[21] Appl. No.: 557,698

[22] Filed: Dec. 2, 1983

[51] Int. Cl.[4] ..... G03G 15/00

[52] U.S. Cl. ..... 355/3 SH; 355/3 FU

[58] Field of Search ..... 355/3 FU, 30; 165/80 D, 165/120, 185; 271/194, 195, 105; 162/206; 34/62, 66

[56] References Cited

U.S. PATENT DOCUMENTS

| | | | |
|---|---|---|---|
| 3,878,622 | 4/1975 | Knechtel et al. . | |
| 3,914,097 | 10/1975 | Wurl | 34/66 |
| 4,003,568 | 1/1977 | Stange et al. . | |
| 4,084,806 | 4/1978 | Wenthe . | |
| 4,092,099 | 5/1978 | Chiba et al. . | |

OTHER PUBLICATIONS

Research Disclosure No. 18445, dated Aug. 1979, p. 430, for "Post-Fuser Copy Sheet Transport".

*Primary Examiner*—A. T. Grimley
*Assistant Examiner*—David Warren
*Attorney, Agent, or Firm*—Donald D. Schaper

[57] ABSTRACT

Apparatus is disclosed for guiding and cooling a heated image-carrying support moved along a path such as a heated copy sheet exiting from a fuser in electrographic apparatus. The apparatus includes a heat-conductive guide member having a guide surface located adjacent to the path along which the support is moved, and a surface remote from the path. The guide member has a vacuum opening at said guide surface. Heat-dissipating structure thermally communicates with the remote surface of the guide member. The apparatus produces a cooling flow of fluid past the guide member and the heat-dissipating structure. A vacuum is established at the vacuum opening independently of the flow of fluid past the guide member to draw a heated support into contact with the guide surface as it is moved along the path. The support is cooled as it transfers heat to the guide member and then to the heat-dissipating structure.

4 Claims, 6 Drawing Figures

APPARATUS FOR GUIDING AND COOLING A HEATED IMAGE-CARRYING SUPPORT

BACKGROUND OF THE INVENTION

This invention relates generally to apparatus for guiding and cooling a heated image-carrying support moved along a path. More particularly, this invention relates to apparatus for guiding and cooling a copy sheet carrying a fused toner image as it exits from a heated fuser.

Typically, in the electrographic process, an original is illuminated by a light source to form an image which is projected upon a photoconductive member to produce a latent electrostatic image corresponding to the original. The latent electrostatic image is developed by means of fusible particles to produce a visible toner image which is transferred to a support such as a copy sheet of plain paper. The unfused toner image may be fixed to the support by means of heat and pressure by passing a copy sheet carrying an unfused toner image through the nip of a pair of rollers, at least one of which is heated. A fused copy sheet exiting from the roller nip has been heated by the heated roller and its toner image is in a tacky state. The copy sheet also has a tendency of curling due to the drying out of the sheet during fusing and due to the curvature of the fusing nip. Thus, it is desirable to cool the copy sheet after it exits from the fuser in order to minimize curling and to prevent copy sheets from sticking together in an output tray. Cooling the copy sheet also prevents image smear and thermal hazard and messiness to an operator handling a hot copy sheet having a tacky toner image.

Various proposals have been made to handle and cool copy sheets as they exit from a fuser. For example, in U.S. Pat. No. 4,003,568, issued Jan. 18, 1977, for "Fluid Conveyer," by K. K. Stange et al, there is disclosed apparatus for transporting and cooling toner bearing sheets discharged from a fuser. The apparatus is provided with a pair of passageways in which an air flow is created (1) by means of a vacuum located at one end of the passageways and (2) of a source of pressurized air to direct the copy sheets out of the passageways in a direction transverse to the entering direction. Commonly assigned U.S. Pat. No. 3,914,097, issued Oct. 21, 1975, for "Sheet Guide and Cooling Apparatus," by D. R. Wurl, discloses apparatus having a thermally conductive surface located at the exit of a fuser for guiding and cooling sheets bearing a developed image exiting from the fuser. Vacuum means are associated with the surface to draw a copy sheet into contact with the surface and to provide a flow of cooling air to cool the surface. Research Disclosure No. 18445, dated August 1979, page 430, for "Post-Fuser Copy Sheet Transport," discloses a post-fuser transport that prevents curl in copy sheets exiting from a heated roller fuser by means of upper and lower air plenums which supply a flow of air along the copy sheet path to cool the copy sheet as it is transported through a tunnel formed by the plenums.

Although the techniques for guiding and cooling a copy sheet exiting from a fuser disclosed in the above disclosures may have been suitable for the purposes for which they were intended, in each of these disclosures, there is only one fluid flow for both cooling and guiding the copy sheet. The single fluid flow functions to draw a copy sheet into contact with a guide member which cools the copy sheet and also to cool the guide member.

SUMMARY OF THE INVENTION

According to the present invention, apparatus is provided for guiding and cooling a heated image-carrying support as it is moved along a path. The apparatus includes a heat-conductive guide member having (1) a guide surface located adjacent to said path, and (2) a surface remote from said path, said guide member having means for defining a vacuum opening at the guide surface. Means for dissipating heat thermally communicates with said remote surface of the guide member. The apparatus includes means for producing a cooling flow of fluid past the remote surface of the guide member and past the heat-dissipating means. Means are provided for establishing a vacuum at said vacuum opening defining means independently of said flow of fluid past said remote surface of said guide member to draw a heated image-carrying support into contact with said guide surface as it is moved along said path so that the support is cooled as it transfers heat to the guide member and thence to said heat-dissipating means.

Thus, according to the invention, cooling of copy sheets is effected in a more efficient manner which allows higher rates of copy sheets to be processed by the fuser. Moreover, the copy sheet is delivered to an output tray in a flat, cool condition so that stacked sheets will not stick together and image smearing is minimized.

The invention and its objects and advantages will become more apparent in the detailed description of the preferred embodiment presented below.

BRIEF DESCRIPTION OF THE DRAWINGS

In the detailed description of the preferred embodiments of the invention presented below, reference is made to the accompanying drawings, like elements having like numbers, in which.

DESCRIPTION OF THE PREFERRED EMBODIMENTS

The guiding and cooling apparatus of the present invention is adapted to be used in electrographic apparatus such as that shown and described in commonly assigned U.S. Pat. No. 3,914,047. As disclosed in the latter patent, electrographic apparatus includes an endless photoconductive member moved around a path past various work stations. The photoconductive member is charged with an electrostatic charge at a charging station and a light image of a document is projected onto the charged photoconductive member to form a latent electrostatic image corresponding thereto. The electrostatic image is then developed with oppositely charged heat fusible toner particles to produce a visible toner image which is subsequently transferred to a support such as a web or copy sheet brought into contact with the photoconductive member at a transfer station. The support carrying the unfused toner image is separated from the photoconductive member and passed through the nip of a heated roller fuser to permanently fuse the toner image to the copy sheet which is then transported to an output tray.

Figure 1:
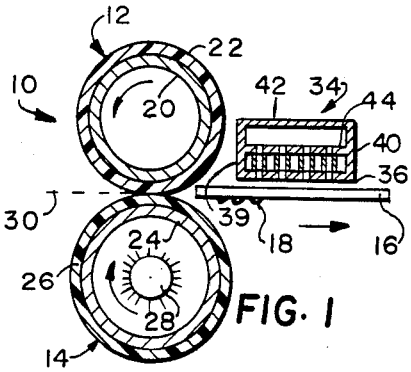
FIG. 1 is a partially cross-sectional side elevational view of guiding and cooling apparatus according to the present invention located at the exit of a roller fuser.
Figure 2:
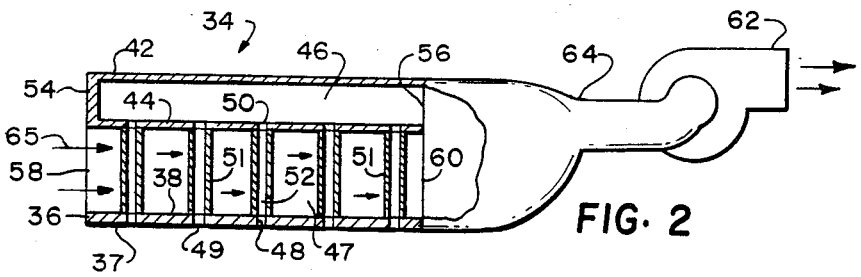
FIG. 2 is a partially sectional front elevational view of the guiding and cooling apparatus of FIG. 1.

Referring now to FIGS. 1 and 2, there is shown one embodiment according to the present invention of apparatus for guiding and cooling a heated copy sheet exiting from a roller fuser. As shown, roller fuser 10 comprises rollers 12 and 14 which form a nip through which a copy sheet 16 carrying a toner image 18 is passed in order to fuse toner image 18 to sheet 16 through the application of heat and pressure. Roller 12 comprises a cylindrical core 20 and an outer layer 22 of high-temperature resistant material having good release properties such as polytetrafluoroethylene. Roller 14 comprises a heat-conductive core 24 and an outer fusing layer 26 of high-temperature resistant elastomeric material having good release properties such as silicone elastomer. Located within roller 14 is a heat source 28 such as a quartz lamp which heats roller 14 to fusing temperature. Copy sheet 16 is moved along a path 30 which extends through the nip formed by rollers 12 and 14.

According to the present invention, apparatus for guiding and cooling a heated copy sheet 16 is located adjacent to path 30 at the exit of roller fuser 10. The apparatus includes a housing 34 having a guide member 36 with a guide surface 37 located adjacent to path 30 and a surface 38 remote therefrom. Housing 34 also includes side members 39 and 40 and upper member 42 which form with member 36 a rectangular structure which spans the width of path 30 and is dimensioned to guide the widest copy sheet processed by fuser apparatus 10.

Housing 34 is provided with a separator member 44 which is located between guide member 36 and upper member 42 and which partitions housing 34 into first and second chambers 46 and 47, respectively. Guide member 36 is provided with a plurality of passages 48 which extend through member 36 and which have vacuum openings 49 at guide surface 37. Separator member 42 is provided with a plurality of passages 50 extending therethrough which are complementary to passages 48 of guide member 36.

Located within chamber 47 is heat-dissipating means including a plurality of heat-dissipating members 51 thermally contacting remote surface 38 of guide member 37 and extending between members 36 and 44. Members 51 include passages 52 aligned with passages 48 of member 36 and passages 50 of member 44. As shown in FIG. 2, chamber 46 is closed at one side by means of member 54 and has an opening 56 at the other side thereof. Chamber 47, on the other hand, has an opening 58 on one side and an opening 60 on the other side thereof. An air mover, such as blower 62, communicates with chambers 47 and 46 by means of air duct 64. Blower 62 establishes in chamber 46 a vacuum which is communicated to vacuum openings 49, through passages 48 in guide member 36, through passages 52 in heat-dissipating members 51 and through passages 50 in separator member 44. This vacuum draws heated copy sheet 16 into contact with guide surface 37 of guide member 36 as it is moved along path 30. Copy sheet 16 is thus cooled as it transfers heat to conductive guide member 36 so that sheet 16 has been substantially cooled by the time it ends contact with guide member 36.

The heat transferred to guide member 36 by sheet 16 is conducted through member 36 which is heat-conductive. This heat is both radiated from surface 38 and conducted to heat-dissipating members 51 which thermally contact member 36. Members 51 act as extended surfaces of member 36 to more rapidly dissipate heat. Blower 62 produces a flow of air 65 through chamber 47 from outside of housing 34 through opening 58, past members 51 to carry off the heat radiated therefrom. This fluid flow through chamber 47 also cools guide member 36 which radiates heat absorbed from heated copy sheet 16. Blower 62 exhausts the heated air from the environment surrounding the fuser apparatus.

Figure 3:
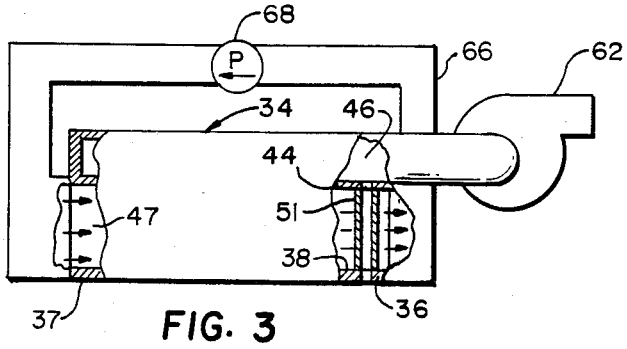
FIG. 3 is a partially sectional diagrammatic view of another embodiment of guiding and cooling apparatus according to the present invention.

Referring now to FIG. 3, there is shown another embodiment of the present invention. As shown, blower 62 establishes a vacuum in chamber 46 in order to attract a copy sheet into contact with guide member 36. Heat from sheet 16 is transferred to member 36 which dissipates it into chamber 47 from surface 38 and from heat-dissipating members 51. A flow of fluid through chamber 47 past members 51 is produced by a closed loop system in which a cooling fluid such as water may be recirculated over conduit 66 by means of fluid pump 68. Heat carried away from chamber 47 may be irradiated by conduit 66 or by other means (not shown). In the embodiment of FIG. 3, the cooling of member 36 and members 51 is highly efficient and capable of carrying off large quantities of heat. More rapid cooling of copy sheets 16 is thus effected so that the number of copy sheets per hour processed by fuser apparatus 10 may be increased.

Figure 5:
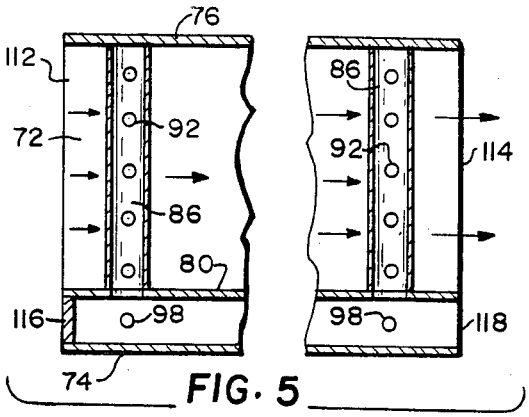
FIGS. 4 and 5 are a partially cross-sectional side elevational view and a partially sectional top plan view, respectively, of another embodiment of guiding and cooling apparatus according to the present invention.
Figure 4:
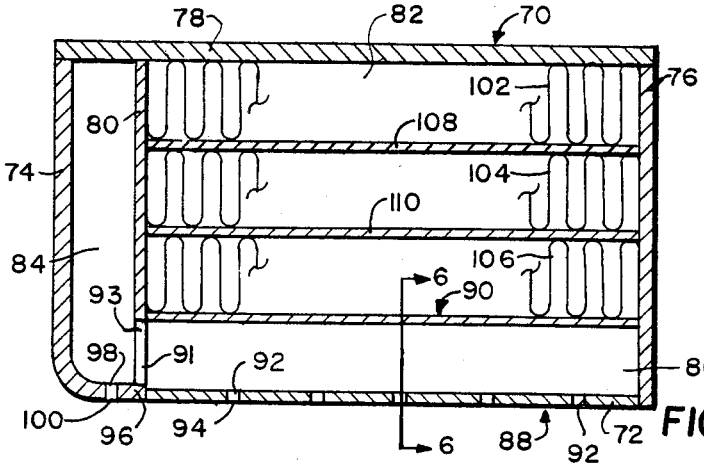
Figure 6:
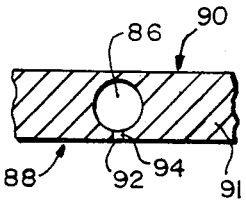
FIG. 6 is a partially sectional elevational view taken along line 6—6 of FIG. 4 showing a segment of the guide member of the apparatus of FIGS. 4 and 5.

Referring now to FIGS. 4 and 5, there is shown another embodiment of sheet guiding and cooling apparatus according to the present invention. The apparatus includes a housing 70 having a guide member 72, side members 74 and 76 and top member 78. A separator member 80 partitions housing 70 into first chamber 82 and second chamber 84. Guide member 72 has a plurality of spaced passages 86 which extend the length thereof parallel to and between guide surface 88 and remote surface 90. Passages 86 communicate with chamber 84 through an opening in side face 91 of member 72 (FIG. 4) and through passage 93 in separator member 80. A plurality of passages 92 extend transversely to passage 86 and have openings 94 at guide surface 88. A lower extension 96 of member 74 abuts member 72 and is provided with a passage 98 having an opening 100.

Heat-dissipating structure is provided in chamber 82 in contact with surface 90 of guide member 72 and includes a stack of thin corrugated members 102, 104 and 106 with separator members 108 and 110. Members 102, 104, 106, 108, 110 are of heat-conductive material and are in contiguous thermal contact.

Chamber 82 has respective openings 112 and 114 at either end, whereas chamber 84 is closed at one end by member 116 and has an opening 118 at its other end. A blower (not shown) communicates with chamber 84 to establish a vacuum therein which is communicated to openings 94 at guide surface 88 through passages 93 in separator member 80, through passages 86 and 92 in guide member 72 and to opening 100 through passage 98 in member 74 to draw a heated copy sheet into contact with heat-conductive guide member 72. This heat is transferred to heat-dissipating members 102–110 by guide member 72. The blower also communicates with chamber 82 to produce a flow of cooling air past members 72 and 102–110 to carry off heat radiated by these members.

Thus, it is seen there is provided apparatus for guiding and cooling a heated image-carrying support moved along a path such as a copy sheet exiting from a heated fuser roller. The heated support is delivered to an output tray in a flat and cool condition. Thus, stacked supports will not stick together and image smearing is minimized. Cooling of copy sheets is effected in a more efficient manner which allows higher rates of copy sheets to be processed by the fuser.

The invention has been described in detail with particular reference to the preferred embodiments thereof, but it will be understood that variations and modifications can be effected within the scope and spirit of the invention.

What is claimed is:

1. Apparatus for guiding and cooling a heated copy sheet as it is moved along a path which extends from a fuser, said apparatus comprising:

a housing which includes a heat-conductive guide member having a guide surface located adjacent to said path and a surface remote from said guide surface, said guide member having a plurality of vacuum openings at said guide surface;

a separator member within said housing for partitioning said housing into at least first and second chambers, said second chamber being bounded on one side by said guide member;

means for producing a first flow of fluid through said second chamber to cool said guide member;

means for defining a plurality of passages which extend between respective vacuum openings in said guide member and said first chamber; and vacuum means for producing a second flow of fluid in said first chamber and in said passages to draw a heated copy sheet into contact with said guide surface as it is moved along said path, said second flow of fluid being separate from and independent of said first flow of fluid.

2. Apparatus, as defined in claim 1, wherein said means for defining a plurality of passages is positioned in said second chamber to contact said first flow of fluid to thereby dissipate heat from said guide member.

3. Apparatus, as defined in claim 2, wherein said vacuum means includes a first fluid movement means operatively connected to said first chamber, and said means for producing a first flow of fluid includes a second fluid movement means operatively connected to said second chamber.

4. Apparatus, as defined in claim 1, wherein said means for defining a plurality of passages includes a passage network in said guide member, and said second chamber contains heat-dissipating structure in thermal contact with said remote surface.

* * * * *